United States Patent [19]

Bennitt

[11] Patent Number: 5,015,158

[45] Date of Patent: May 14, 1991

[54] GAS COMPRESSOR

[75] Inventor: Robert A. Bennitt, Painted Post, N.Y.

[73] Assignee: Dresser-Rand Company, Corning, N.Y.

[21] Appl. No.: 433,257

[22] Filed: Nov. 8, 1989

[51] Int. Cl.[5] ..... F04B 21/08

[52] U.S. Cl. ..... 417/525

[58] Field of Search ..... 417/525, 534

[56] References Cited

U.S. PATENT DOCUMENTS

| | | | |
|---|---|---|---|
| 213,692 | 3/1899 | Richmond | 417/525 |
| 1,602,193 | 10/1926 | Garber | 417/525 |
| 2,295,592 | 9/1942 | McConnohie | 417/525 X |

FOREIGN PATENT DOCUMENTS

| | | | |
|---|---|---|---|
| 786969 | 9/1935 | France | 417/525 |

*Primary Examiner*—Robert G. Nilson

*Attorney, Agent, or Firm*—Bernard J. Murphy

[57] ABSTRACT

The compressor is formed of a simple, straight cylinder clamped between end headers by means of tie bolts. Confined within the cylinder are inlet valves—one at each end thereof—and inlet ports formed in the cylinder open onto these valves. A reciprocable piston rod carries a pair of spaced-apart discharge valves thereon. The latter valves, having annular bodies, have piston ring grooves formed thereabout, to receive sealing piston rings therein; too the discharge valves serve as the gas compressing pistons.

4 Claims, 5 Drawing Sheets

GAS COMPRESSOR

This invention pertains to gas compressors, and in particular to a gas compressor of novel design in which the compression cylinder thereof confines therewithin both the inlet and discharge valves, and the latter valves are piston ringed to serve as the gas compressing pistons.

Conventional, prior art gas compressors require inlet and discharge valves, and gas compressing pistons. Too, commonly, the valves are external to the compression cylinder.

It is an object of this invention to set forth a novel gas compressor which obviates any need for separate pistons, and such a compressor of simple, albeit efficient configuration.

Particularly it is an object of the this invention to set forth a gas compressor comprising a cylinder having a longitudinal axis; and headers at opposite ends of said cylinder; wherein one of said headers has a tapped hole formed in a surface thereof which opens onto said cylinder; the other of said headers has a tapped bore opening therethrough; and a first inlet valve threadedly engaged with said tapped hole and confined within said cylinder; a second inlet valve threadedly engaged with said tapped bore and confined within said cylinder; said second inlet valve has a throughgoing bore formed therein which is coaxial with said tapped bore; a piston rod in penetration of said bores, and having an end projecting outwardly from said other header; a pair of dischange valves coupled to said piston rod, and spaced apart along said rod, confined within said cylinder; gas inlet ports formed in said cylinder at opposite ends thereof; and a gas outlet port formed in said cylinder intermediate said ends thereof.

Further objects of this invention, as well as the novel features thereof, will become more apparent by reference to the following description, taken in conjunction with the accompanying figures, in which.

Figure 1:
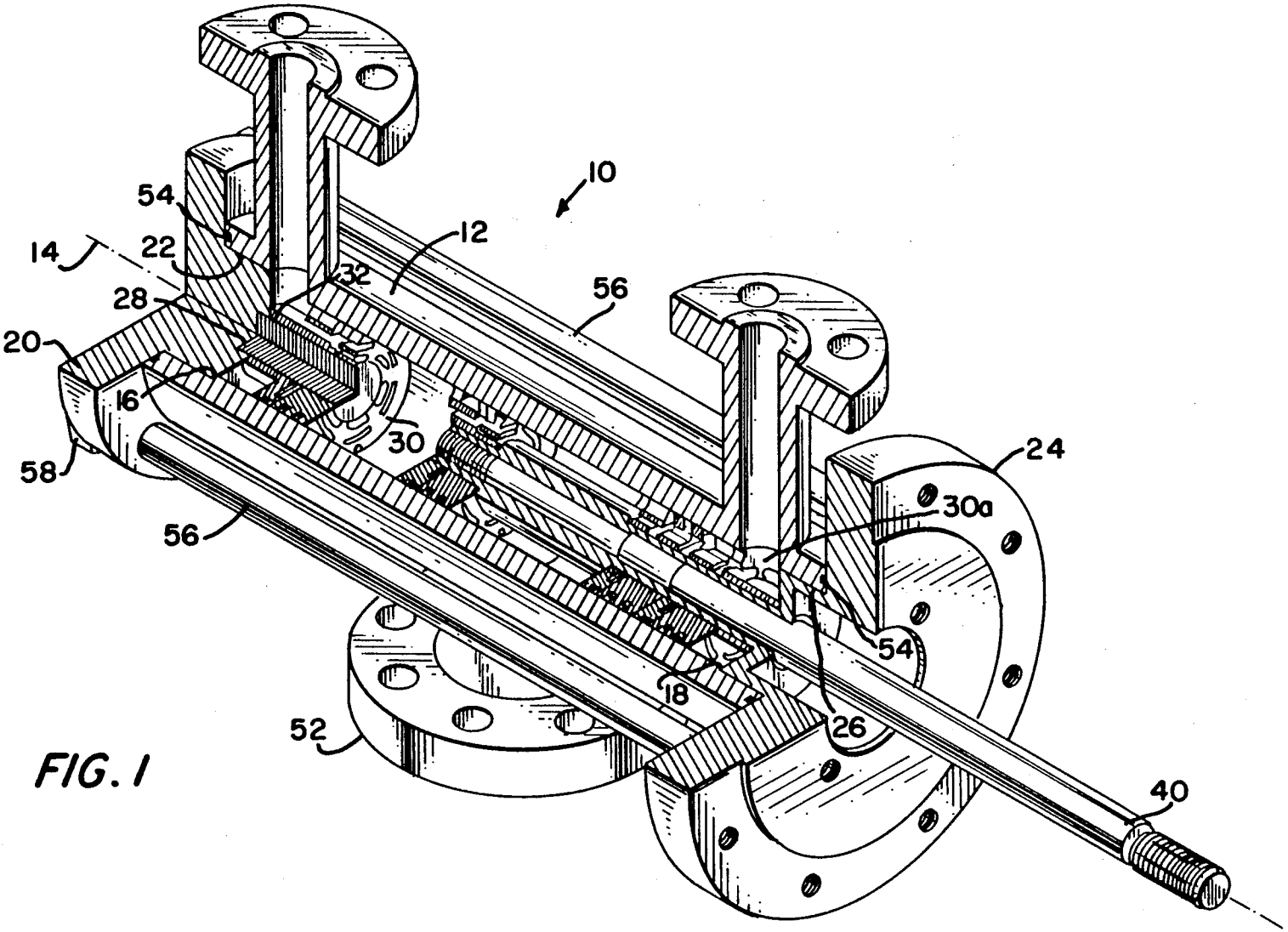
FIG. 1 is a perspective illustration of a gas compressor, according to an embodiment of the invention, the same being partly cut away along the axis thereof.
Figure 2:
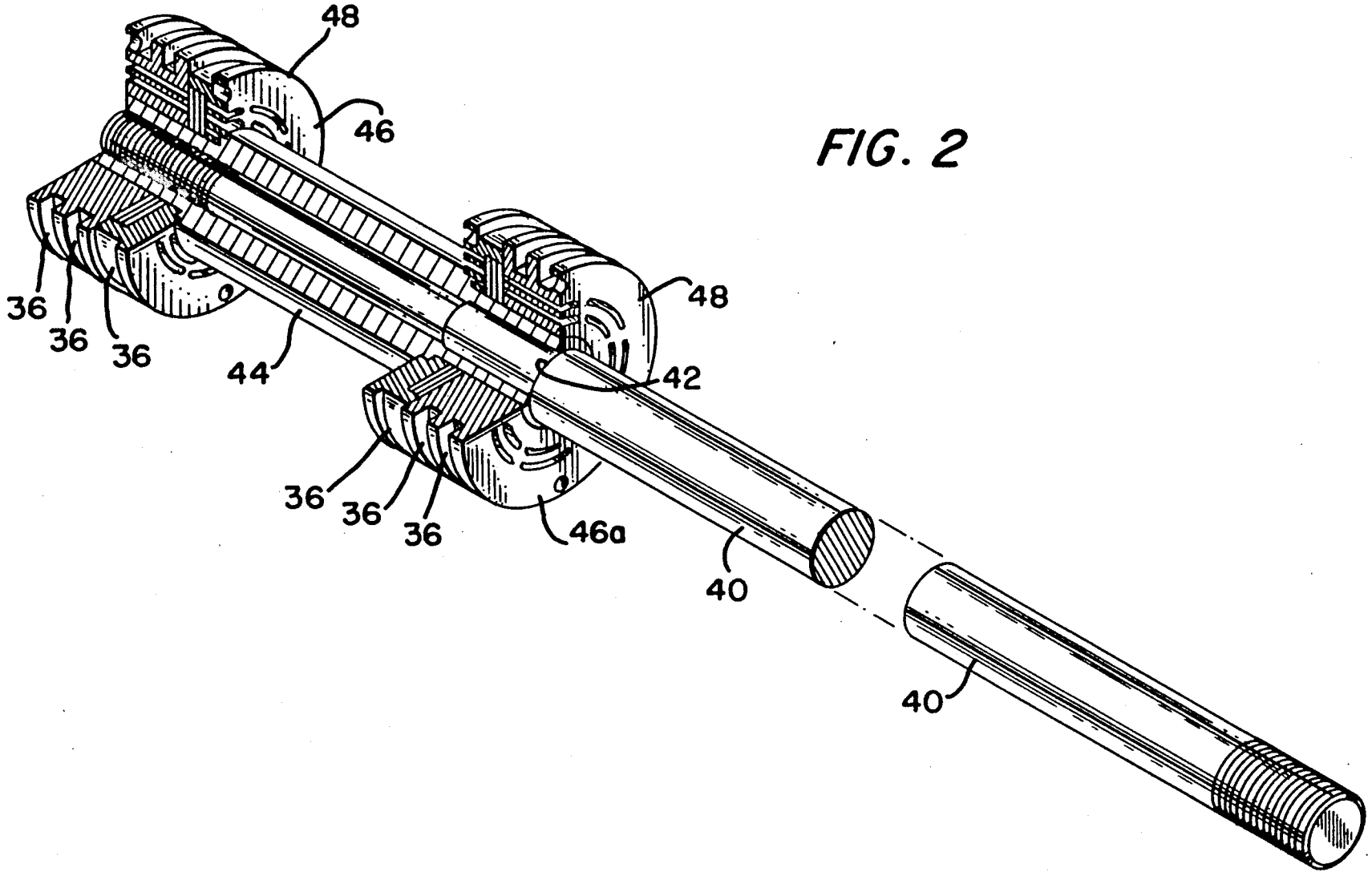
FIG. 2 is a perspective illustration of the piston rod assembly of the FIG. 1 embodiment, the same also being cut away, in part.
Figure 3:
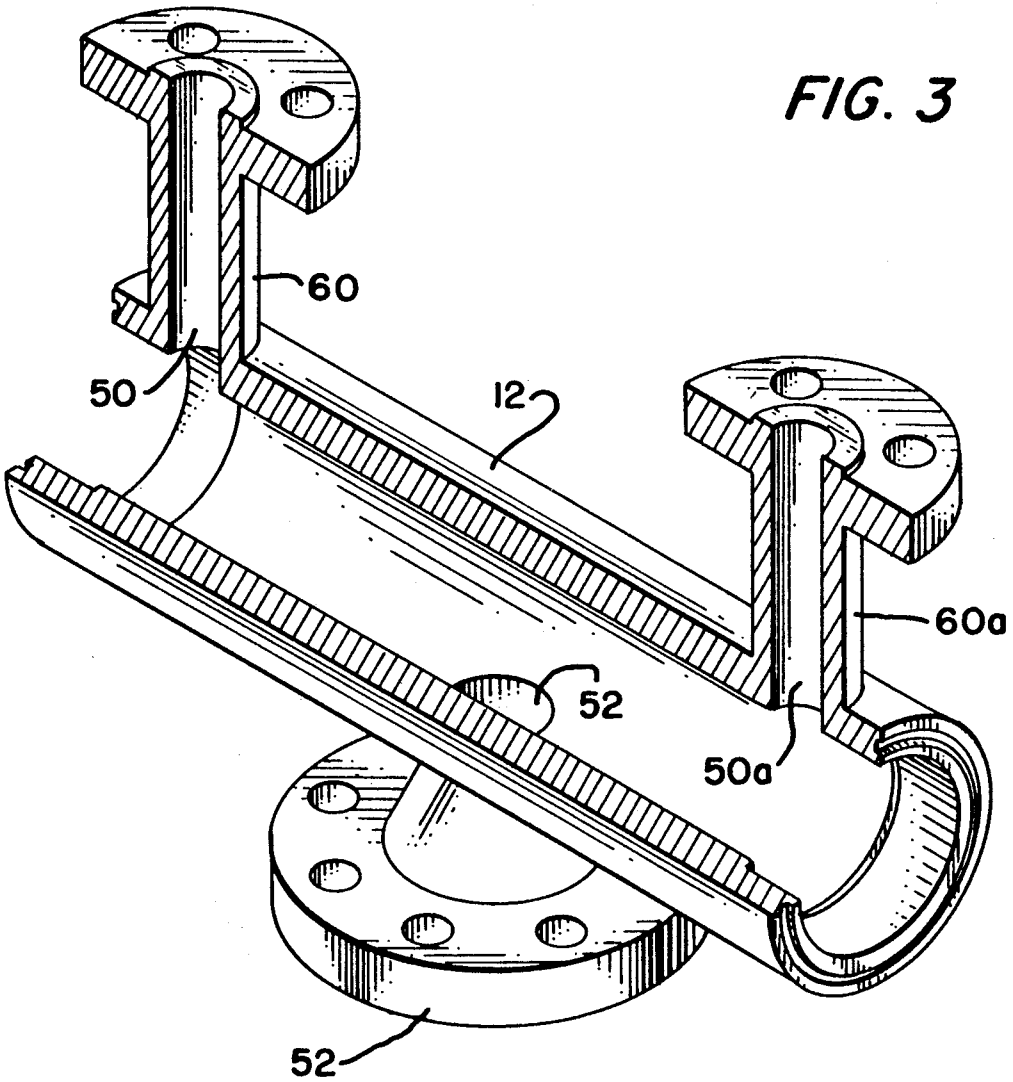
FIG. 3 is a partly cut away perspective illustration of the cylinder and porting.
Figure 4:
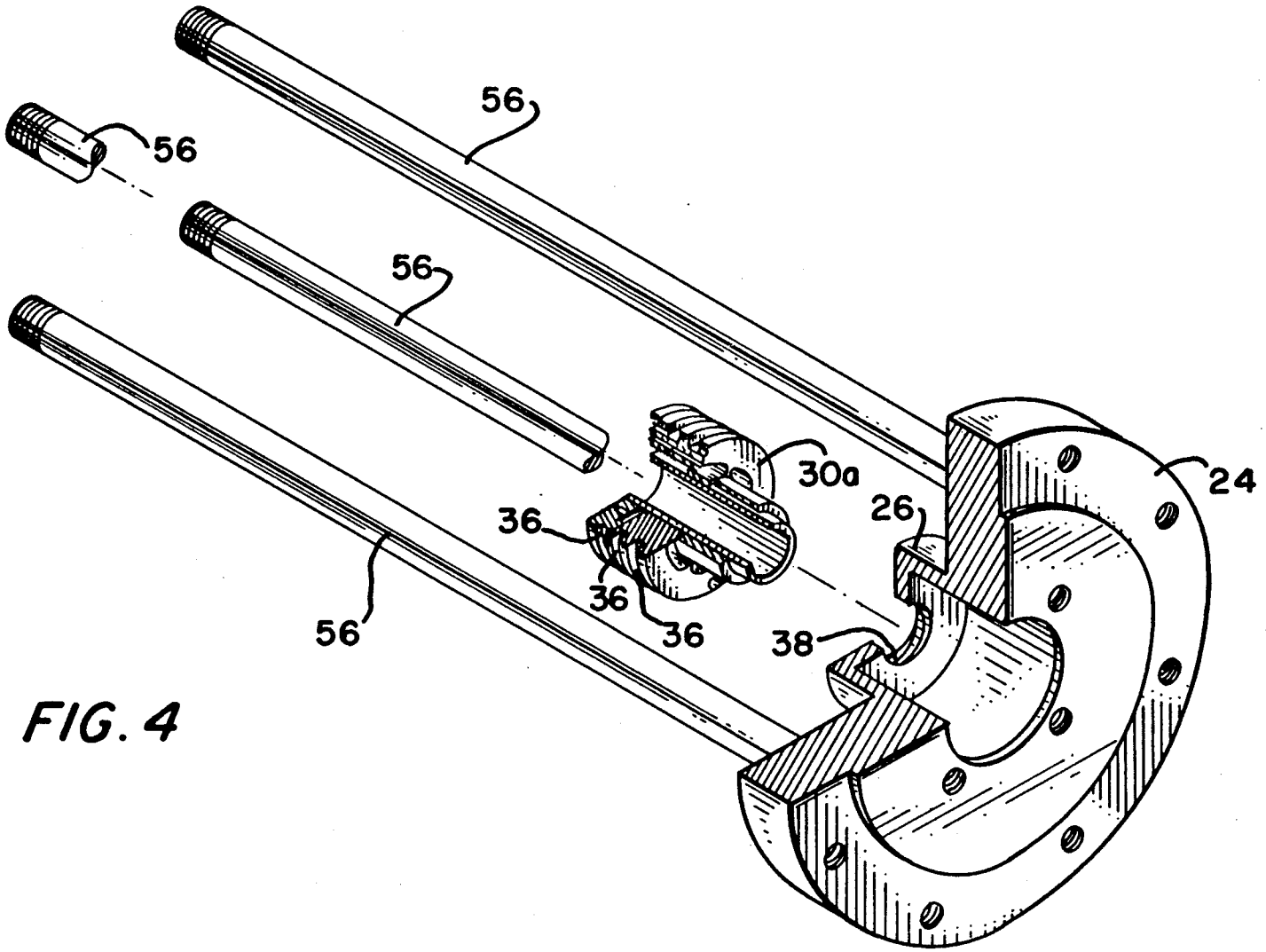
FIGS. 4 and 5 are cut away depictions of the frame header assembly and outer header assembly, respectively, showing the tie rods and the inlet valves.
Figure 5:
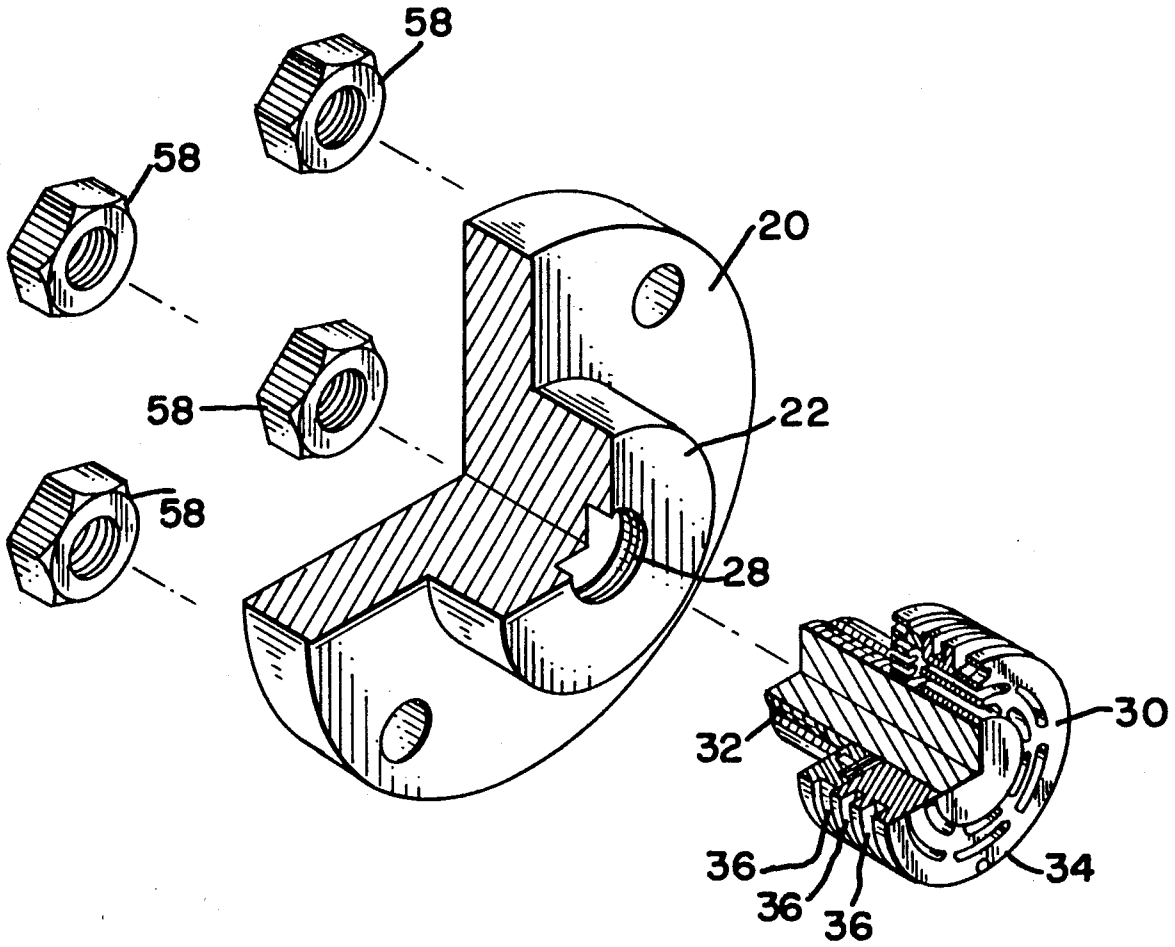

As shown in the figures, the novel gas compressor 10 comprises a straight cylinder 12, having a longitudinal axis 14, with shouldered recesses 16 and 18 at opposite axial ends thereof. An outer header 20, having a prominent, circular land 22 in the center thereof, is set, with an O-ring for sealing, into the recess 16. Similarly, a frame header 24, which also has a prominent, circular land 26 in the center thereof, is set, too with an O-ring for sealing, into the recess 18.

The header 20 has a tapped hold 28 formed in the land 22. An inlet valve 30, having a threaded stub 32, is threadedly engaged with the hole 28. Valve 30, of the one-way, check type, has an annular body 34 with piston ring grooves 36 formed thereabout (in which to receive sealing piston rings). The land 26 in the frame header 24 also has a tapped bore 38 formed therein; it threadedly receives a second inlet valve **30*a*. Valve 30*a***, however, is centrally bored to accommodate therethrough a piston rod.

The piston rod 40 penetrates the tapped bore 38 and is slidably engaged with the central bore in the valve **30*a*. One end of the piston rod 40 projects outwardly from the header 24, via one end thereof, and into the cylinder 12 via the opposite end thereof. The termination of the in-cylinder end of the rod 40 is threaded; too, intermediate the length of the rod 40 there is a shoulder 42. A tubular spacer 44, internally threaded at one end thereof, and externally threaded at opposite ends thereof, is set against the shoulder 42, and threadedly engaged with the threaded termination of the rod 40. A pair of discharge valves 46 and 46*a*, the same having annular bodies 48, are centrally threaded and threadedly engaged with the external threads of the spacer 44. Valve 46 and 46*a*, too, are of the one-way, check type, and also have piston ring grooves formed thereabout in which to nest piston rings for sealing against the inner surface of the cylinder 12**.

A pair of inlet ports 50 and **50*a* are formed in the cylinder, adjacent to the axial ends thereof, the same opening onto the inlet valves 30 and 30*a*. Intermediate the length of the cylinder 12 there is also formed a single discharge port 52. Ends of the cylinder 12 about the headers 20 and 24, and nest, in grooves formed therefor, O-ring seals 54. Tie rods 56, fastened in the header 24 and in penetration of the header 20, receive nuts 58 on threaded ends thereof and clamp the cylinder 12 and headers 20 and 24 securely together. Inlet conduits 60 and 60*a* are welded to the cylinder 12 for communication thereof with the ports 50 and 50*a*, and a discharge conduit 52 is similarly welded to the cylinder 12 for communication with the discharge port 52**.

The simplicity of the configuration of the compressor 10, in this embodiment thereof, can be readily seen; the same offers manufacturing and maintenance ease. More significantly, pistons per se are not required, as the valves 46 and **46*a* serve the double purpose of piston-compression of the gas, valved discharge of the compressed gas. Only inlet and discharge ports need to be formed in the cylinder 12, as the valves 30 and 30*a*, and 46 and 46*a* are confined within the cylinder. The headers 20 and 24 fit firmly into the ends of the simple, straight cylinder 12**, and only the tie rods are required to clamp the assembly together.

While I have described my invention in connection with an embodiment thereof, it is to be clearly understood that this is done only by way of example, and not as a limitation to the scope of my invention, as set forth in the objects thereof, and in the appended claims.

I claim:

1. A gas compressor, comprising:

a single, straight cylinder having (a) a longitudinal axis, and (b) a single, circumferential wall; and headers secured to opposite axial ends of said cylinder; wherein one of said headers has a tapped hold formed in a surface thereof which opens into said cylinder;

the other of said headers has a tapped bore opening therethrough, centrally thereof; and a first inlet valve threadedly engaged with said tapped hole and confined within said cylinder;

a second inlet valve threadedly engaged with said tapped bore and confined within said cylinder; wherein said second inlet valve has a throughgoing bore formed therein which is coaxial with said tapped bore;

a piston rod in penetration of said bores, and having an end thereof projecting outwardly from said other header;

a pair of discharge valve coupled to said piston rod, and spaced apart along said rod, confined within said cylinder; and gas inlet ports, radially formed in said cylinder adjacent opposite ends of said cylinder, opening in immediate proximity to said inlet valves; wherein said piston rod has a shoulder formed thereabout intermediate the length thereof, and is externally threaded at the end thereof which is opposite said projecting end thereof; and further including a tubular spacer, internally threaded at one end thereof, and externally threaded at opposite ends thereof; wherein said spacer is set about said opposite end of said piston rod, having an end thereof abutting said shoulder, and said internally threaded end thereof is threadedly engaged with said opposite end of said piston rod;

said discharge valves are centrally bored and threaded;

said discharge valves are threadedly engaged with said externally threaded ends of said spacer; and a gas outlet port formed in said cylinder intermediate said ends thereof.

2. A gas compressor, according to claim 4, wherein:

said discharge valves have annular bodies; and said bodies have piston ring grooves formed thereon to accommodate therein piston rings for effecting sealing engagement with said cylinder.

3. A gas compressor, according to claim 1, wherein:

opposite axial ends of said cylinder have shouldered recesses formed therein;

said header have circular, prominent lands in the centers thereof; and said lands are set into said shouldered recesses.

4. A gas compressor, according to claim 1, wherein:

said first inlet valve has an externally threaded stub extending therefrom, centrally thereof; and said threaded stub is threadedly engaged with said tapped hold for fixing said first inlet valve within said cylinder.

* * * * *